US006048257A

United States Patent [19]

Greenman et al.

[11] Patent Number: 6,048,257

[45] Date of Patent: Apr. 11, 2000

[54] ABRASIVE PAD HOLDER

[75] Inventors: Gerald L. Greenman, Geneva, Ohio; Gerald D. Murray, Latrobe, Pa.

[73] Assignee: Kennametal Inc., Latrobe, Pa.

[21] Appl. No.: 09/165,900

[22] Filed: Oct. 2, 1998

[51] Int. Cl.[7] ..... B24B 7/00

[52] U.S. Cl. ..... 451/162; 451/163; 451/173; 451/324

[58] Field of Search ..... 451/173, 162, 451/163, 164, 166, 324, 902, 52, 460

[56] References Cited

U.S. PATENT DOCUMENTS

| | | | |
|---|---|---|---|
| 1,896,946 | 2/1933 | Gauss | 451/527 |
| 1,909,661 | 5/1933 | Cobb | 451/324 |
| 2,244,806 | 6/1941 | Schmidt | 451/173 |
| 2,254,508 | 9/1941 | Barrett | 451/540 |
| 2,276,611 | 3/1942 | Connor | 451/173 |
| 2,277,589 | 3/1942 | Hanson | 451/65 |
| 2,337,183 | 12/1943 | Canning | 451/324 |
| 2,536,479 | 1/1951 | Watts | 451/480 |
| 2,606,410 | 8/1952 | Thery | 451/173 |
| 3,063,205 | 11/1962 | Fermskog | 451/324 |
| 3,099,853 | 8/1963 | Bills | 15/97.1 |
| 3,146,552 | 9/1964 | Croshaw et al. | 451/168 |
| 3,800,475 | 4/1974 | Portal | 451/168 |
| 4,922,662 | 5/1990 | Zygiel | 451/150 |
| 5,730,647 | 3/1998 | Becker et al. | 451/173 |
| 5,800,252 | 9/1998 | Hyatt | 451/61 |

*Primary Examiner*—Rodney Butler
*Attorney, Agent, or Firm*—Larry R. Meenan

[57] ABSTRACT

A holder for an abrasive element used to abrade the surface of a workpiece. The holder is made of an abrasive pad resiliently mounted upon a holder in a manner providing to the pad multiple degrees of freedom of motion.

14 Claims, 8 Drawing Sheets

ABRASIVE PAD HOLDER

CROSS-REFERENCE TO RELATED APPLICATIONS

This application is related to the following co-pending applications, which have been filed on the same day as the subject application and which have the same inventors:

(1) Apparatus and Method for Abrading a Workpiece (Applicant Reference K-1442W);

(2) Reciprocating Assembly for Abrading a Workpiece (Applicant Reference K-1442X); and (3) Abrasive Pad (Applicant Reference K-1442Z).

BACKGROUND OF THE INVENTION

1. Field of the Invention

The invention is directed to an apparatus for holding an abrasive pad used for abrading the surface of a workpiece.

2. Background Art

The final stages of producing a vehicle brake drum are directed to providing a smooth irregular pattern on the inside of the brake drum using a three-step process. In the first step a single point cutting tool for roughing is applied to bore the inner diameter of the work surface as the drum is rotated. In the second step a single point cutting tool for semi-finishing is applied to the roughed work surface. In both steps, as the tool is fed along the work surface, feed lines form in a spiral pattern. These feed lines are objectionable for commercial applications because a brake pad applied to a surface having this pattern will engage the spiral grooves of the feed lines and be forced to move laterally when the brake is applied causing brake slap. This condition is unacceptable because a lateral force on the brake shoe prematurely wears the material on the brake shoe and also a significant lateral force on the brake shoe may damage the associated brake hardware. For these reasons, these spiral grooves must be eliminated.

Therefore, the third step of the process involves using an abrasive paper applied to the drum surface under pressure by a device that looks similar to a brake drum shoe. During this process a kerosene based coolant is run over the abrasive paper and workpiece. The step involves using a specially built machine that is dedicated to this process as well as additional equipment for cleaning and swarf removal.

A disadvantage of this three-step process exists because one machine is used for the first two steps and a second machine is used for the third step. As a result, the brake drums are transferred from one machine to another and are subjected to runout and imbalance conditions which is referred to as transfer error and which occurs when parts are moved from one machine to another and as a result are chucked on different surfaces of each machine. If the roughing/semi-finishing operations and the surface finish operation could be performed on the same machine, then an improvement of overall part quality as well as a reduction in the number of required machine tools, cycle time and cost would be possible.

An additional factor that may affect the quality of the surface finish is the manner in which the abrasive element, such as the abrasive paper, is supported relative to the workpiece. U.S. Pat. No. 2,606,410 entitled "Device for Superfinishing Machined Surfaces" discloses in FIG. 6 a superfinishing abrasive stone 13 mounted with a pinned connection upon a leaf spring 12 which is urged against the inner surface of a rotating cylinder 44. The stone 13 is not restrained from rotating about the pinned connection and therefore there may not be uniform pressure exerted upon the cylinder 44 across the face of the stone 13.

U.S. Pat. No. 2,244,806 entitled "Honing Apparatus" is directed toward a device for honing the tapered surface 2 of a workpiece "a" using a strip 23 of abrasive material supported by a bar 21. The bar 21 is connected to a spring 19 by a pivot connection using pivot pin 22. Furthermore, the bar 21 is urged against the surface 2 by a single spring 24 seated in a recess 25 of bar 21. While this arrangement pivotally urges the strip 23 against the surface 2, just as with the '410 patent, there may not be uniform pressure exerted upon the surface 2 across the face of the strip 23.

U.S. Pat. No. 2,276,611 entitled "Honing Device" is directed toward a device for honing a conical race 7 of a bearing utilizing a honing stone 12. The patent illustrates in FIG. 1 the use of two coil springs to urge the stone 12 against the race 7. The stone 12 is supported in a spindle and spring pressed outwardly by coil springs. However, there appear to be only two springs utilized which may result in non-uniform pressure exerted upon the race 7 by the stone 12. Furthermore, the stone 12, as illustrated in FIG. 1, is axially restrained by the walls of the spindle in which the stone 12 rests. As a result, it may be possible for the stone 12 to bind within the spindle.

A device is needed to support an abrasive element against a workpiece but permit movement so the element may conform to the shape of the workpiece and also be urged against the workpiece with a relatively uniform pressure across the face of the abrasive element.

BRIEF SUMMARY OF THE INVENTION

A holder is provided for an abrasive pad reciprocated with a reciprocating assembly to finish the surface of a moving workpiece. The holder has a housing which is attached to the reciprocating assembly. The housing has a mounting surface. The holder also has an abrasive pad with a mounting surface which is oriented opposite the housing mounting surface. At least one primary spring is positioned between the mounting surface of the housing and the mounting surface of the abrasive pad urging the housing and abrasive pad apart. A connector is secured to one of the housing or abrasive pad and captured by the other to allow multiple degrees of motion between the pad and housing but limit the maximum distance between the respective opposing mounting surfaces.

Other objects and advantages of the present invention will become apparent and obvious from the study of the following description and accompanying drawings which are merely illustrative of such invention.

DESCRIPTION OF THE PREFERRED EMBODIMENT

Figure 1:
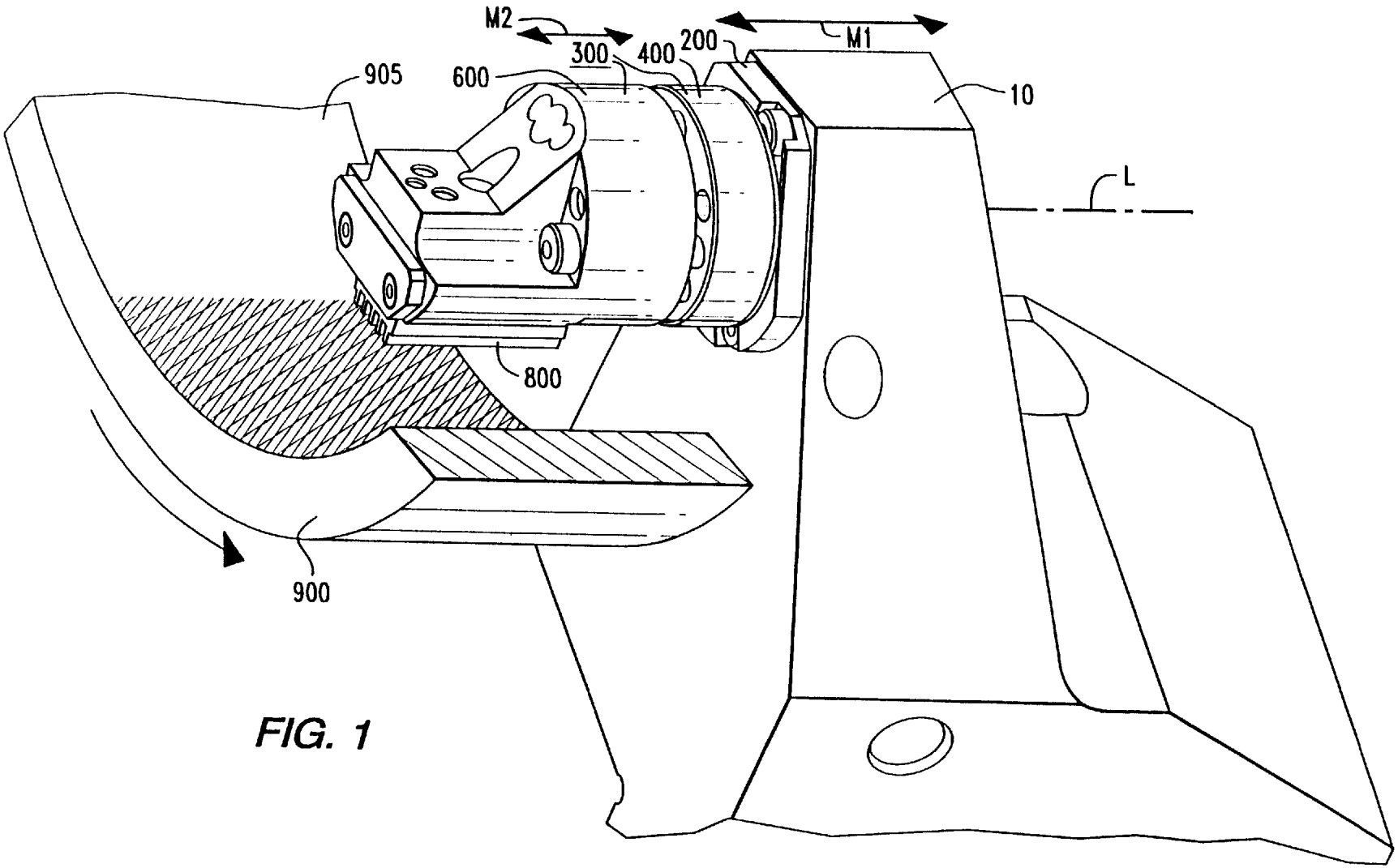
FIG. 1 illustrates a perspective view of the apparatus according to the present invention applied to a cylindrical rotating workpiece.

As illustrated in FIG. 1, the apparatus is generally comprised of an adapter 10 which is mounted to a slide 11 (FIG. 2) of a machine tool such as a lathe. A clamping unit 200 is secured to the adapter 10. A reciprocating assembly 300, made up of a reciprocating unit 400 and a holder 600, is secured to the clamping unit 200. The holder 600 is slidingly attached to the reciprocating unit 400. An abrasive pad 800 is resiliently mounted to the holder 600. The abrasive pad 800 contacts and machines a workpiece 900 on a surface 905. The workpiece 900 may be, for example, linearly moving or, as illustrated in FIG. 1, moving by rotation. It is also possible for the workpiece 900 to remain stationary and for the abrasive pad 800 to move over the surface of the workpiece 900.

Figure 2:
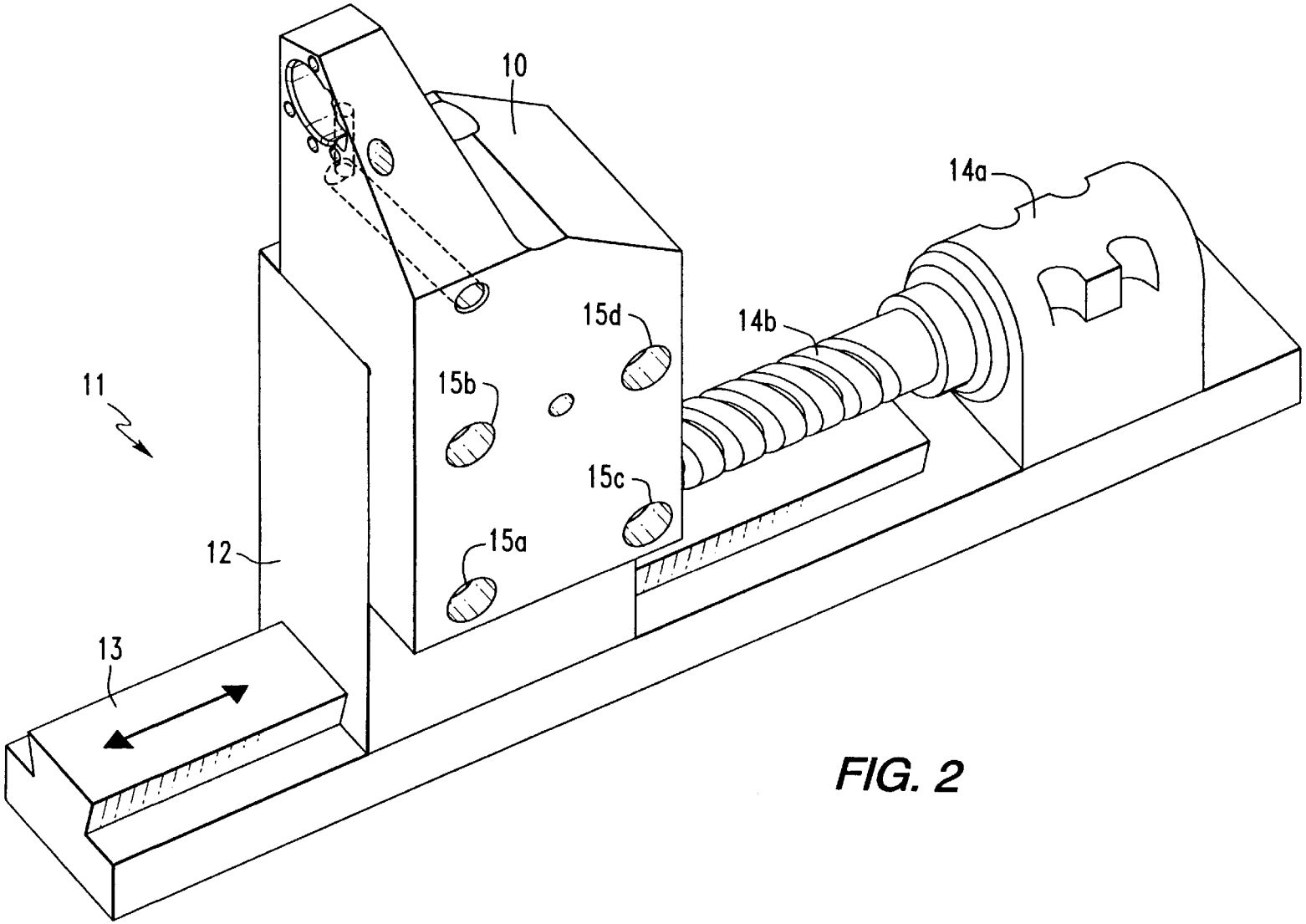
FIG. 2 illustrates a sketch showing a perspective view of the slide of a typical machine tool.

The slide 11 (FIG. 2) of the lathe is attached to the adapter 10 and positions the abrasive pad 800 (FIG. 1) against the surface 905 of the workpiece 900. For clarity, the clamping unit 200 and reciprocating assembly 300 are not illustrated in FIG. 2. From this starting position, a slide 11 of the lathe may move the abrasive pad 800 (FIG. 1) in a linear reciprocating motion illustrated by arrow M1 over the surface 905 along a longitudinal axis L. FIG. 2 shows the adapter 10 mounted upon what is generally referred to as a slide 11 comprised of a base 12 to which the adapter 10 is attached. The slide 11 is part of the machine tool. In FIG. 2 the workpiece 900 (not shown) would be secured to the lathe by a chuck or similar holding device to the left of the adapter 10 in a position similar to that shown by workpiece 900 in FIG. 1.

The base 12 may be guided along a mating dovetail rail 13 by a ball screw assembly made up of a motor coupling 14*a* and a ball screw 14*b*. The ball screw 14*b* engages the base 12 and moves it back and forth along the rail 13. In this fashion the slide 11 may be used to reciprocate or to position the abrasive pad 800. However, as will be discussed, reciprocating motion from the slide 13 may not be required.

Returning to FIG. 1, the reciprocating unit 400 moves the holder 600 in a second linear reciprocating motion indicated by arrow M2 along the same longitudinal axis L. In general, the amplitude of the reciprocating motion M2 is lower but the frequency of reciprocation is higher than for that associated with the M1 motion.

Figure 3A:
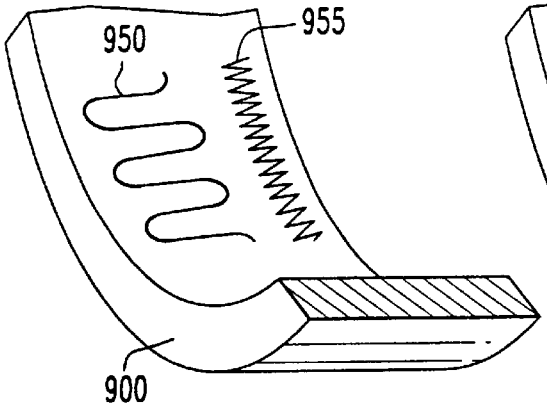
FIGS. 3*a,* 3*b* and 3*c* illustrate surface patterns produced by the apparatus in accordance with the present invention when applied to a moving workpiece.

FIG. 3*a* illustrates on the workpiece 900 the surface pattern established by one point on the abrasive pad 800 (FIG. 1) from the independent motions of the machine tool and the reciprocating assembly. Surface pattern 950 is produced by the abrasive pad when the entire assembly is moved by the machine tool as indicated by arrow M1. In the instance where the motion M1 is a repeating reciprocal motion and the workpiece 900 is rotating at a constant rate, then the pattern 950 will be a repeating sinusoidal wave. This is the pattern produced by many of the prior art abrasive devices and is objectionable because, as previously mentioned, this produces a regular surface pattern which may produce harmonic vibration when such a surface is used as a part of a vehicle braking system.

To modify this pattern, the reciprocating assembly 300 (FIG. 1) introduces a second linear motion M2 which has, in general, a lower amplitude but a higher frequency. The motion indicated by arrow M2 (FIG. 1) produces a surface pattern 955 on the workpiece surface 905 as illustrated in FIG. 3*a*. Just as with the pattern illustrated by 950, pattern 955 is also a repeating pattern which is again regular and undesirable for reasons already discussed. However, when the motion illustrated by arrow M1 is superimposed over the motion indicated by arrow M2 then the resulting surface finish 960 as illustrated in FIG. 3*b* becomes irregular and is suitable for use in many applications.

The surface pattern illustrated by 950 is entirely a function of the machine tool and the frequency and amplitude of that reciprocation may be altered within the limits of the machine tool. The surface pattern 955 is a function of the reciprocating assembly design and, as will be discussed, this may be adjusted to vary not only the amplitude and frequency of the reciprocating motion but also the rate of extension and retraction of the abrasive pad. As will be discussed with FIG. 3*c*, it is possible to manipulate the reciprocation of the reciprocating assembly to produce an irregular pattern on the workpiece surface without the need to reciprocate the adapter using the slide on the machine tool.

Figure 3B:
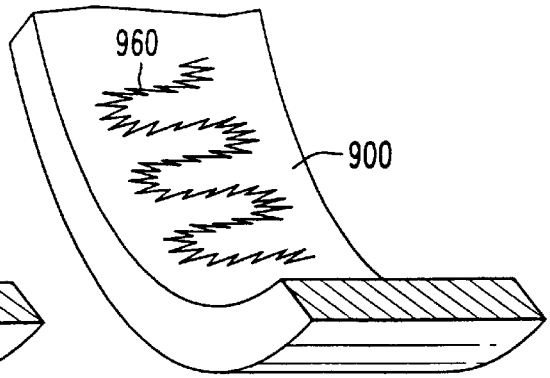
Figure 3C:
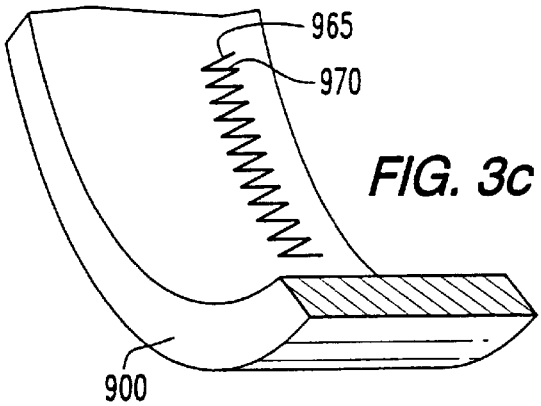

The simplified sketches illustrated in FIGS. 3*a*–3*c* are intended to represent the pattern produced by a single cutting point on an abrasive element. In reality, such an abrasive element will have hundreds, if not thousands, of such cutting points in which cutting point produces such a pattern.

Figure 5:
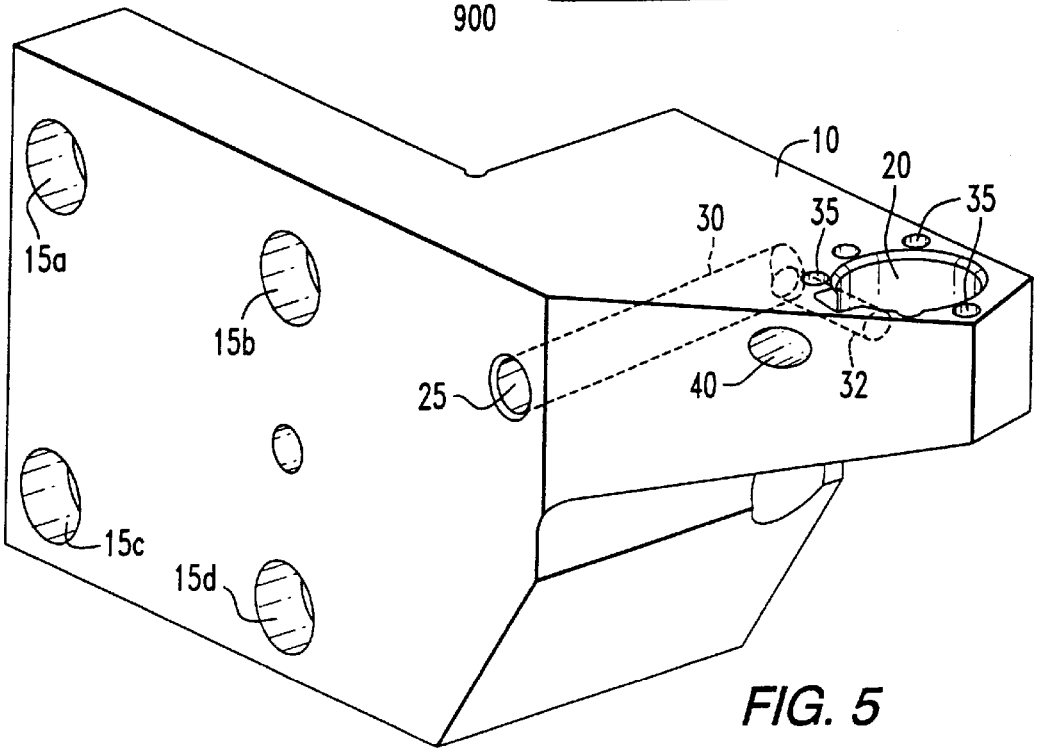
FIG. 5 is a perspective view of the adapter used in the subject invention.
Figures 4, 4A:
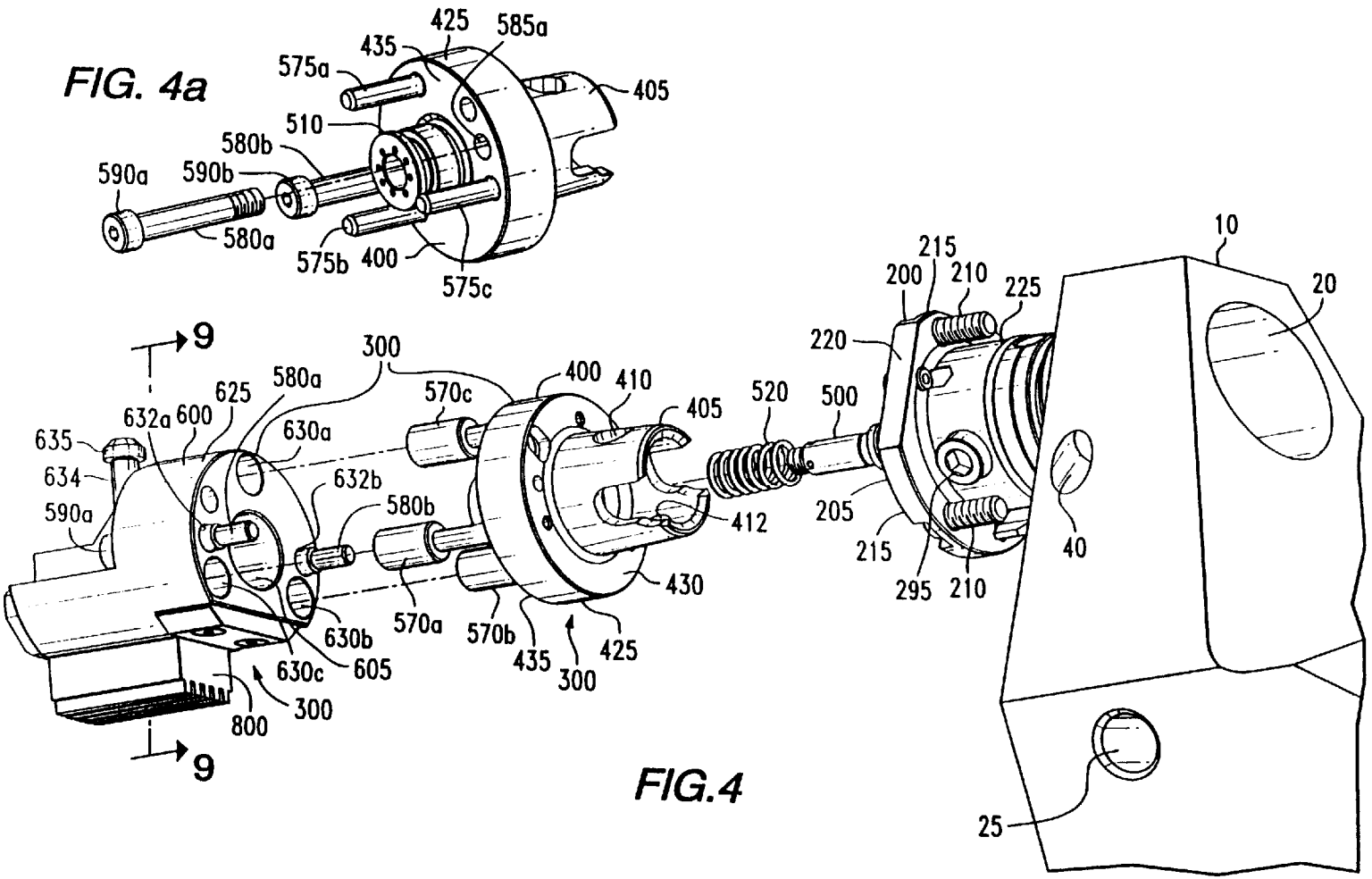
FIG. 4 is an exploded perspective view of the subject invention.
FIG. 4*a* is an exploded perspective view from another angle of the reciprocating unit.

FIGS. 4 and 5 illustrate perspective views of the adapter 10. The adapter 10 has a two-fold purpose. First of all, the adapter 10 is used as a transition to support the apparatus on the slide of a machine tool, such as a lathe (not shown). The adapter 10 is mounted to the slide of a machine tool using at least one mounting hole, although as seen in FIGS. 1, 2 and 5, a plurality of mounting holes 15*a*, 15*b*, 15*c*, 15*d* is illustrated extending through the adapter 10 in a pattern that is compatible with a mating face on the machine tool base 12. This portion of the adapter 10 and the associated hole pattern may be designed to suit any desirable configuration.

Second of all, the adapter 10 is capable of receiving a clamping unit 200 which may be used to secure through a releasable coupling not only the reciprocating unit 400 but also any number of other tools having a compatible coupling. One such tool may be a single point cutting tool used to machine the bore into a brake drum. In this fashion, using the adapter 10 with a releasable coupling, it is possible to perform multiple machining operations upon the workpiece without remounting the workpiece on a different machine for each operation. This eliminates the previously discussed transfer error.

For one embodiment described herein, the reciprocating assembly 300 (FIG. 4), comprised of the reciprocating unit 400 and housing 600 mounted within a bore 20 in the adapter 10, is operated by fluid under pressure. The ability to provide fluid under pressure is standard on most machine tools. Therefore, inlet port 25 on the adapter 10 is an inlet to an internal passageway 30 (FIG. 5) extending to the bore 20 which communicates with the reciprocating assembly 300. By utilizing fluid pressure already available through the machine tool, the need for an external or auxiliary pump to provide such fluid pressure is eliminated. Furthermore, the fluid is communicated to the reciprocating assembly 300 by internal passageways through the hardware of the clamping unit 200, thereby eliminating external pipes and tubes which typically are cumbersome.

While it is entirely possible to mount the reciprocating unit 400 of the reciprocating assembly 300 directly to the adapter 10, it is also possible to mount the reciprocating unit 400 to the adapter 10 through an intermediate clamping unit 200 which allows easy installation and removal of the reciprocating unit 400 to and from the adapter 10. A male shank 405 on the reciprocating unit 400 is received within a mating opening 205 (FIG. 7) in the clamping unit 200 and locked therein. There are many commercially available clamping mechanisms which are suitable for such a coupling between the reciprocating unit 400 and a base such as adapter 10 and the details hereinafter describe only one such clamping mechanism.

The clamping unit 200 is secured to the adapter 10 using threaded bolts 210 (FIG. 4) which extend through drilled holes 215 through a flange 220 (FIG. 6) into mating threaded openings 35 in the adapter 10 (FIG. 5). The body 225 (FIG. 4) of the clamping unit 200 is generally cylindrical and fits into the bore 20 of the adapter 10.

Figure 6:
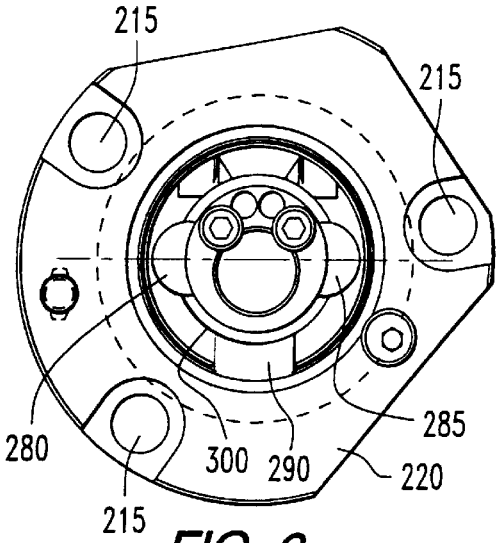
FIG. 6 is an end view of a clamping unit utilized in the subject invention.
Figure 7:
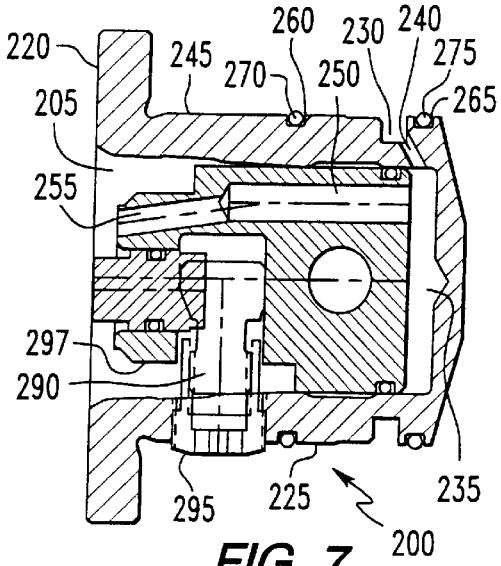
FIG. 7 is a side view of the clamping unit illustrated in FIG. 6.

Further details of the clamping unit 200 are shown in FIGS. 6 and 7. FIG. 7 illustrates a side cross-sectional view of the clamping unit 200. To effectively communicate the pressurized fluid from the adapter 10, the passageway 30 (FIG. 5) extends into passageway 32 in the adapter 10 (FIG. 5) which penetrates the adapter bore 20. This penetration is aligned with groove 230 (FIG. 7) in the clamping unit 200 and fluid pressure is communicated to the internal cavity 235 of the clamping unit 200 through ports 240 extending from the groove 230 through the wall 245. The fluid is then directed through passageways 250 and 255 which extend the length of the clamping unit 200 where the fluid is then connected to mating passageways in the reciprocating unit 400. Seals 270 and 275 are positioned within grooves 260 and 265 about the body 225 of the clamping unit 200 and contact the walls of the bore 20 (FIG. 4) when mounted in the adapter 10 to contain the pressurized fluid.

Referring to FIG. 4, the clamping unit 200 secures the male shank 405 of the reciprocating unit 400. This is done, referring to FIGS. 6 and 7, utilizing balls 280, 285 which are radially expanded by a cam 290 to engage apertures 410, 412 (FIG. 4) extending radially in the male shank 405 of the reciprocating unit 400. Details of one such arrangement are found in U.S. Pat. No. 4,736,659 which is hereby incorporated by reference and for which Kennametal Inc. is a co-assignee.

The cam 290 has a cam head 295 rotatable within the body 225 of the clamping unit 200 such that when the cam head 295 is rotated the male shank 405 of the reciprocating unit 400 may be secured or released within the clamping unit 200.

When the clamping unit 200 is mounted within the adapter 10, access to the cam head 295 is through the cam screw access hole 40 (FIGS. 4 and 5).

Figure 8:
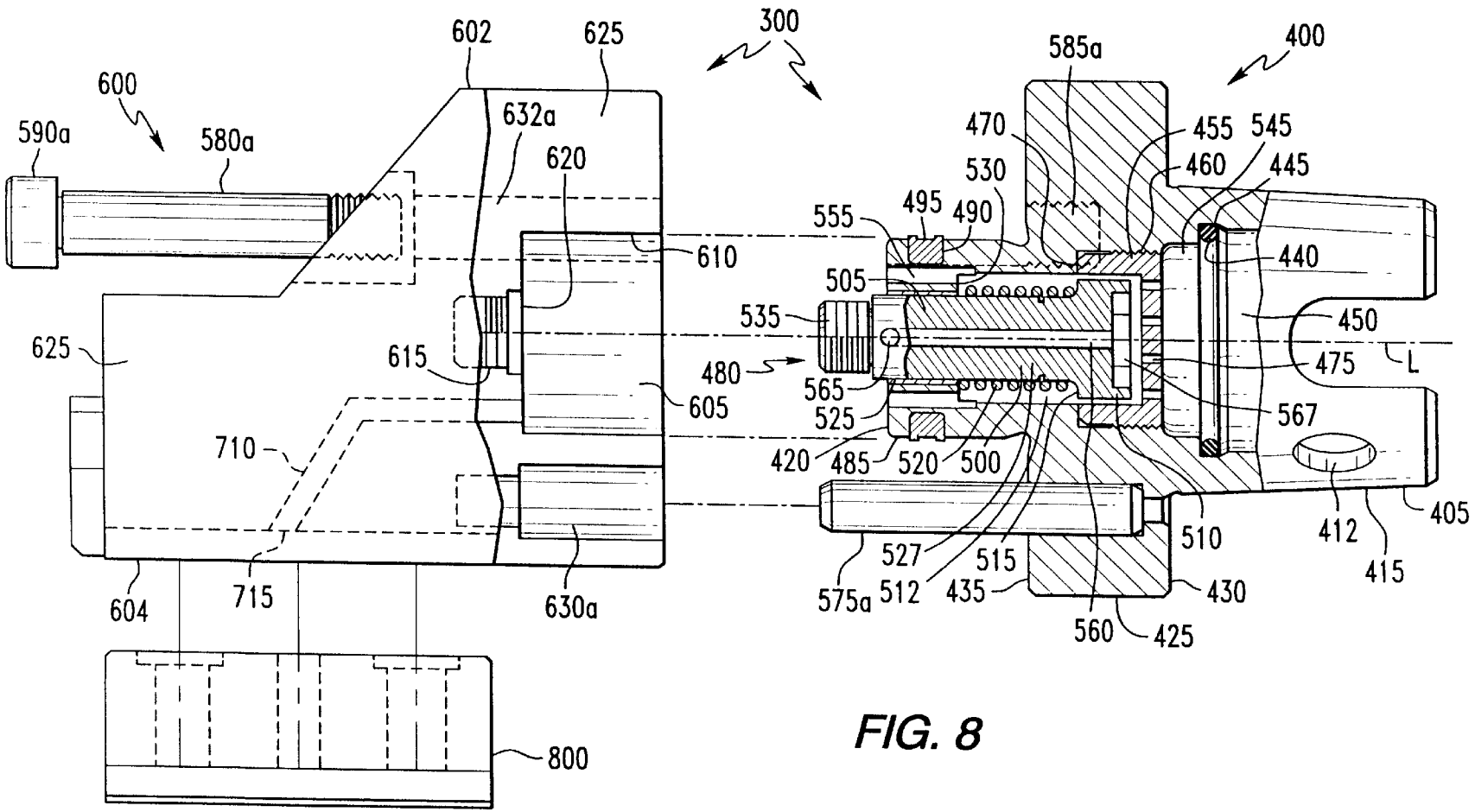
FIG. 8 is an exploded section view of the reciprocating assembly made up of the reciprocating unit and the holder.

FIG. 8 illustrates a section view of the reciprocating assembly 300 made up of the reciprocating unit 400 and the holder 600. For clarity, the reciprocating unit 400 illustrated in FIG. 8 has been slightly rotated from the position relative to the housing 600 shown in FIG. 4.

The reciprocating unit 400, in addition to the male shank 405 already discussed, generally has a back end 415 and a front end 420 and a center portion 425 having a rear face 430 and a front face 435. When the reciprocating unit 400 is mounted to the clamping unit 200, the rear face 430 contacts the flange face 220 (FIG. 4) of the clamping unit 200. Furthermore, when the reciprocating unit 400 is mounted to the clamping unit 200, a seal 440 which is mounted within a groove 445 adjacent the internal portion of the male shank 405 surrounds a circular canister 297 (FIG. 7) within the clamping unit 200, thereby providing a fluid seal.

The reciprocating unit 400 has a longitudinal bore 450 about longitudinal axis L extending therethrough. Insertable from the back end 415 of the reciprocating unit 400, a threaded plug 455 is secured within the longitudinal bore 450 by mating threads 460 on the plug 455 and on the center portion 425 of the reciprocating unit 400. The plug 455 rests against a shoulder 470 in the center portion 425 of the reciprocating unit 400. The threaded plug 455 has a plurality of fluid passages 475 extending therethrough.

A piston assembly 480 is comprised of a piston head 485 extending from the front end 420 of the reciprocating unit 400. The piston head 485 has a groove 490 which captures a seal 495. The holder 600, which has a top 602 and a bottom 604, also has a piston cylinder 605 in which the piston head 485 is slidably engaged. When the piston cylinder 605 encompasses the piston head 485, the seal 495 engages the piston cylinder side wall 610 and fluid pressure introduced into the piston cylinder 605 will urge the holder 600 and the attached abrasive pad 800 from a retracted position to an extended position. The preferred pressurized fluid is a compressible fluid and preferably air.

A restraining rod 500 has a rod first end 505 and a rod second end 510. The rod 500 extends through a hollow 512 in the piston head 485. The rod 500 has a shoulder 515 at the second end 510 which engages a coil spring 520 extending along the intermediate portion 527 of rod 500 between the shoulder 515 and a lip 530 which protrudes radially into the hollow 512 around the rod first end 505. In this manner the rod 500 is biased to the right, when viewed in FIG. 8.

The rod first end 505 is supported by bearings 525, has a threaded shank 535 and engages a mating threaded bore 615 extending into the end wall 620 of the piston cylinder 605. Therefore, the restraining rod 500 is screwed into the end wall threaded bore 615 and the restraining rod 500 and housing 600 thereafter move as a single unit. When fluid pressure is applied within the piston cylinder 605, the holder 600 moves to the left in FIG. 8 but only to the extent the pressure is sufficient to overcome the bias imparted by the coil spring 520 and, as will be discussed, to the extent limit stops permit.

Pressurized fluid is introduced from passageway 255 (FIG. 7) to a fluid inlet chamber 545 at the back end 415 of the reciprocating unit 400. The fluid travels through the fluid passages 475 of the threaded plug 455 and into the hollow 512 around the rod second end 510 of the restraining rod 500 through ports 555 extending through the piston head 485 into the piston cylinder 605 of the housing 600. The pressurized fluid then acts against the piston cylinder 605 to force the holder 600 and the restraining rod 500 to the left. Pressurized fluid is also introduced to the piston cylinder 605 through internal passageway 560 extending through the restraining rod 500 to port 565.

The pressurized fluid injected from the relief port 565 into the piston cylinder 605 will furthermore be utilized in conjunction with the holder 600 in a manner to be discussed.

For reference, when the housing 600 is displaced to the left by pressurized fluid entering the piston cylinder 605, the piston assembly 480 and the pad holder 600 are considered to be in the extended position. Motion toward the extended position is counteracted by the force of the spring 520 against the shoulder 515 of the restraining rod 500. When the fluid pressure is relieved, the housing 600 will be displaced to the right and the piston assembly 480 and the pad holder 600 are considered to be in the retracted position.

It is possible to select one of many springs 520 having different spring rates, thereby affecting the length of the stroke of the holder 600 when it is extended and affecting the velocity with which such extension is achieved. When the holder 600 has reached the extended position, the flow of pressurized fluid is momentarily stopped such that the force of the spring 520 against the shoulder 515 will return the holder 600 to the retracted position. To promote this return motion, the pressurized fluid is permitted to escape not only back through the piston head ports 555 but furthermore through port 565 and through the internal passageway 560 extending through the restraining rod 500.

By controlling the fluid pressure, the holder 600 may be reciprocated in a controlled fashion. When the pressure of the fluid is increased within the piston cylinder 605, then the spring 520 is compressed until either the fluid pressure is relieved or the force generated by the fluid pressure is counteracted by force generated by the spring 520. In this manner the distance the holder 600 is displaced to the left may be controlled and furthermore the velocity at which the holder 600 travels to the extended position may be controlled.

As mentioned, when the fluid pressure is relieved the holder 600 returns to the retracted position. While the fluid pressure may be relieved gradually, it is preferred to relieve the fluid pressure rapidly such that the force of the spring 520 will return the holder 600 to the retracted position without an opposing force that would exist as the result of residual fluid pressure. Therefore, the rate at which the holder 600 is moved to the extended position may be entirely different from the rate at which the holder 600 is returned to the retracted position. Because of this feature, it is possible to generate an irregular surface pattern exclusively using the reciprocating assembly 300 without the assistance of linear motion provided by slide 11 (FIG. 2) of the machine tool.

FIG. 3*c* illustrates the motion produced by the reciprocating unit 400 when the rate at which the holder 600 travels to the extended position is different than the rate to the retracted position. The extension rate represented by item 965 is slower than the retraction rate 970 thereby producing an irregular saw-tooth pattern without the supplemental motion that may be provided by the slide of the machine tool.

The holder 600 is attached to the threaded shank 535 of the restraining rod 500 and therefore the motion of the holder 600 will be imparted to the restraining rod 500. FIG. 8, along with FIG. 4, furthermore illustrates selected details of the holder 600 shown in an exploded view relative to the reciprocating unit 400. The holder 600 is driven by the reciprocating unit 400 along the longitudinal axis L. The body 625 of the holder 600 has a set of three longitudinal bores 630*a, b* and *c* extending therein to accept linear bearings 570*a, b* and *c* mounted upon bearing posts 575*a, b* and *c* extending from mating positions on the front face 435 of the reciprocating unit center portion 425.

To secure the holder 600 to the reciprocating unit 400, the restraining rod 500 is first inserted through the bearings 525 into the hollow 512 of the reciprocating unit 400 with the spring 520 surrounding the intermediate portion 527 of the rod 500. The restraining rod 500 has a hexagonal cavity 567 which will accept a mating tool so that the threaded shank 535 at the opposite end may be rotated and tightened within the recessed threaded cavity 615 of the holder 600. The threaded plug 455, which also has a hexagonal cavity (not shown), may now be positioned and rotated for tightening against the shoulder 470 within the reciprocating unit 400.

Although the force supplied by spring 520 should be sufficient to limit the maximum extension of the restraining rod 500, shoulder screws 580*a* and 580*b* (FIGS. 4 and 4*a*) extend through shoulder screw bores 632*a* and 632*b* in the holder 625 and are threadingly secured into threaded bore 585*a* (FIGS. 4 and 8) and another bore 585*b* not visible in the front face 435 of the reciprocating unit center portion 425. The distance of the shoulder 590*a* and 590*b* of the shoulder screws 580*a* and 580*b* from the front face 435 of the reciprocating unit 400 will determine the maximum extended position the holder 600 may travel, and in this manner the shoulder screws 580*a* and 580*b* act as limit stops.

FIG. 8 also includes a schematic view of the abrasive pad 800 which will now be explained in further detail relative to the holder 600 through FIGS. 9–10.

Figure 9:
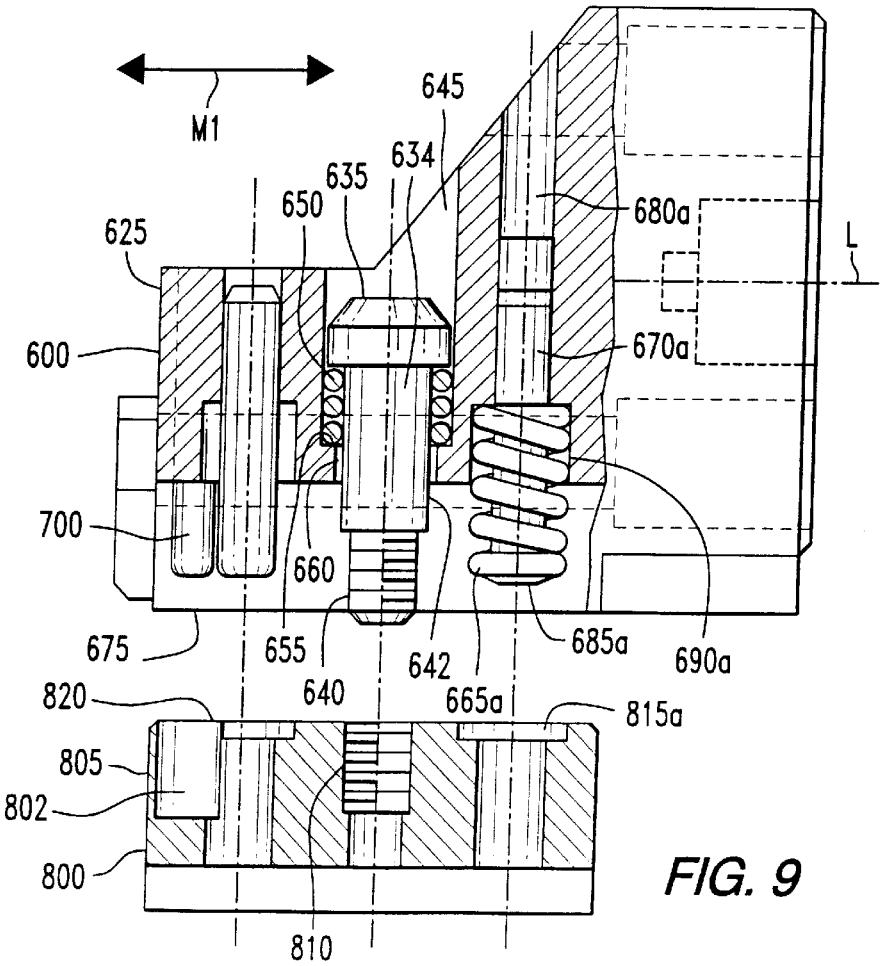
FIG. 9 is an exploded section view of the holder and abrasive pad taken along lines "9—9" in FIG. 4.

FIG. 9 illustrates a section view of the holder 600 and the abrasive pad 800. FIG. 10 shows an exploded perspective view of the holder 600 and abrasive pad 800. As previously mentioned and illustrated in FIG. 1, the holder 600 is displaced by the reciprocating unit 400 in a motion along longitudinal axis L defined by arrow M2.

Figure 10:
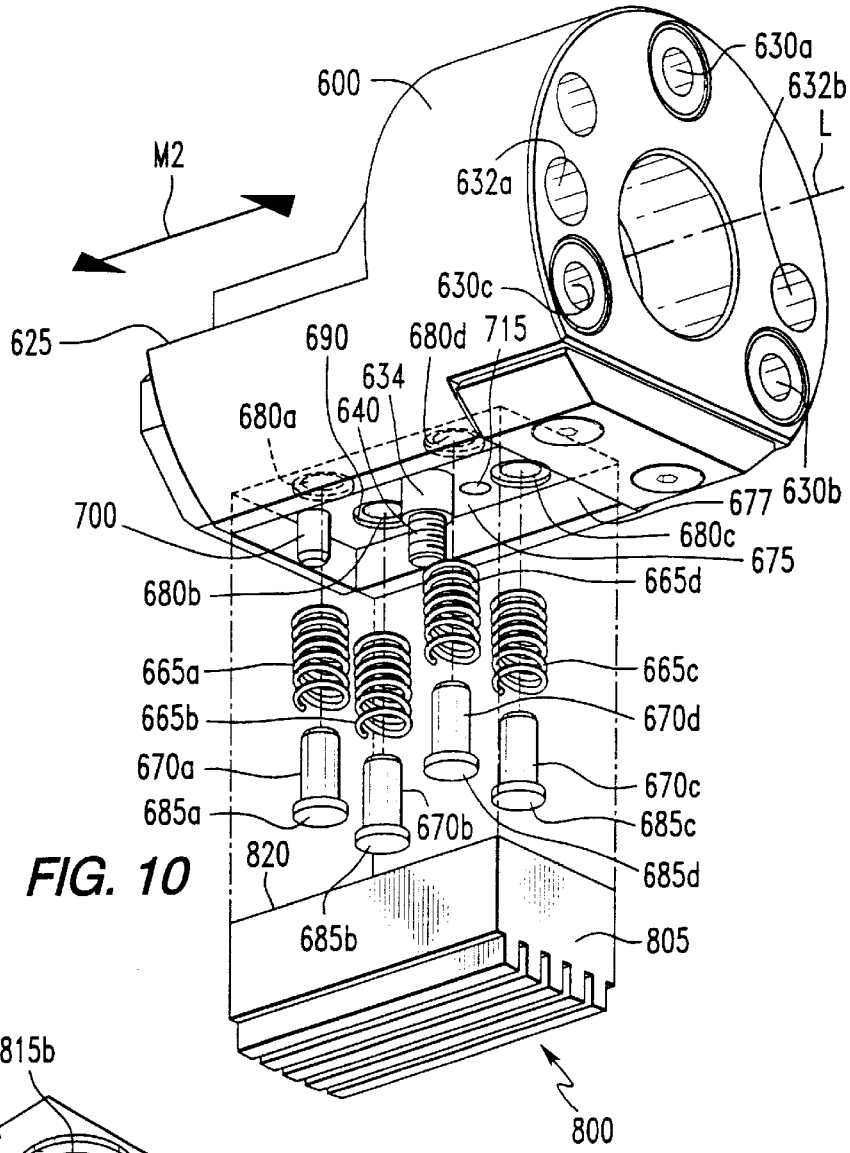
FIG. 10 is an exploded perspective view of the holder and the abrasive pad.

In FIGS. 9 and 10, the abrasive pad 800 is resiliently attached to the body 625 of the holder 600 to permit the pad 800 to move with multiple degrees of freedom. A holder bolt 634 having an enlarged head 635 at one end and a threaded shank 640 at the other end with an intermediate shank 642 therebetween extends through a bore 645 within the body 625. The bolt enlarged head 635 is used to engage and to compress a bolt spring 650 against a shoulder 655 produced by a reduced diameter section 660 of the bore 645. The threaded shank 640 is secured within a threaded mating bore 810 in the abrasive pad base 805.

The diameter of the intermediate shank 642 of the holder bolt 634 is smaller than the diameter of the bore 645 at the reduced diameter section 660 such that the holder bolt 634 and therefore the abrasive pad 800 are permitted extensive lateral and rotational motion within the bore 645. While the bolt spring 650 tends to pull the abrasive pad 800 toward the pad holder 600, primary springs 665*a–d* which are illustrated as coil springs are mounted about dowel pins 670*a–d* positioned about the housing mounting surface 675 of the body 605. The dowel pins 670*a–d* are frictionally located within dowel pin bores 680*a–d* and the primary springs 665*a–d* are captured by heads 685*a–d* on the dowel pins. Each of the primary springs 665*a–d* may be recessed within a counterbore 690 (typical) within the mounting surface 675 of the pad holder housing 605. Each of the primary springs 665*a–d* is positioned against a matching counterbore 815*a–d* recessed within the abrasive pad mounting surface 820 of the abrasive pad base 805. In this configuration the abrasive pad mounting surface 820 is facing and opposite to the housing mounting surface 675. This configuration of springs acts upon the abrasive pad 800 to urge it against the workpiece with relatively uniform pressure across the pad 800.

This arrangement furthermore provides containment of the springs 665*a–d* and also provides a mechanism in which the abrasive pad base 805 is aligned with the holder 600.

The mounting surface 675 is recessed within the body 605 of the housing 600, thereby defining a receiving cavity 677 generally conforming to the shape of the abrasive pad 800.

A locating pin 700 protruding from the pad holder mounting surface 675 extends into a significantly oversized bore 802 within the abrasive pad base 805 and is used to ensure the abrasive pad 800 is mounted upon the pad holder 600 in the proper orientation.

With this configuration the abrasive pad 800 is capable of limited translation and rotation in any direction. The primary springs 665*a–d* are sized to overcome the force of the bolt spring 650 such that the abrasive pad 800 floats on the primary springs relative to the pad holder 600 and thereby is capable of multiple degrees of motion for conforming to an irregular surface on which the abrasive elements 830, which are rigidly secured to the abrasive pad 800, may contact.

Figure 11:
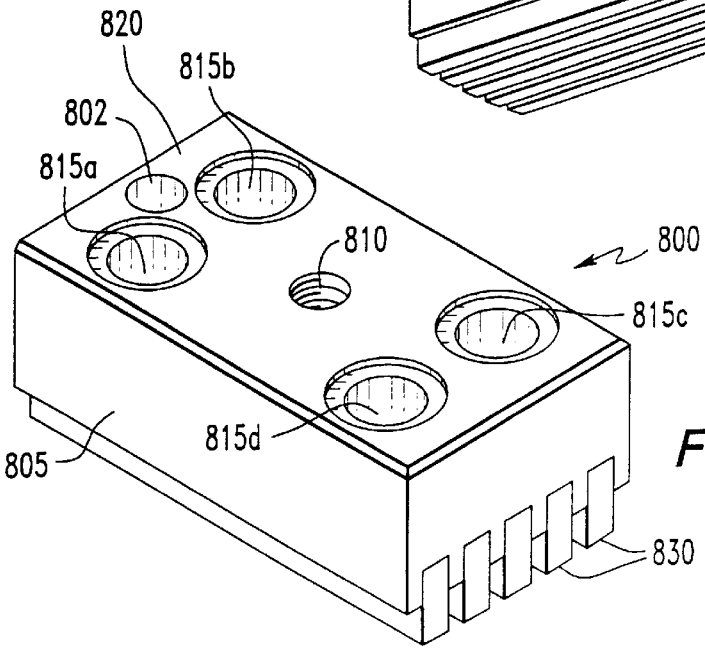
FIG. 11 is a perspective view of the abrasive pad viewed toward the bottom face.
Figure 12:
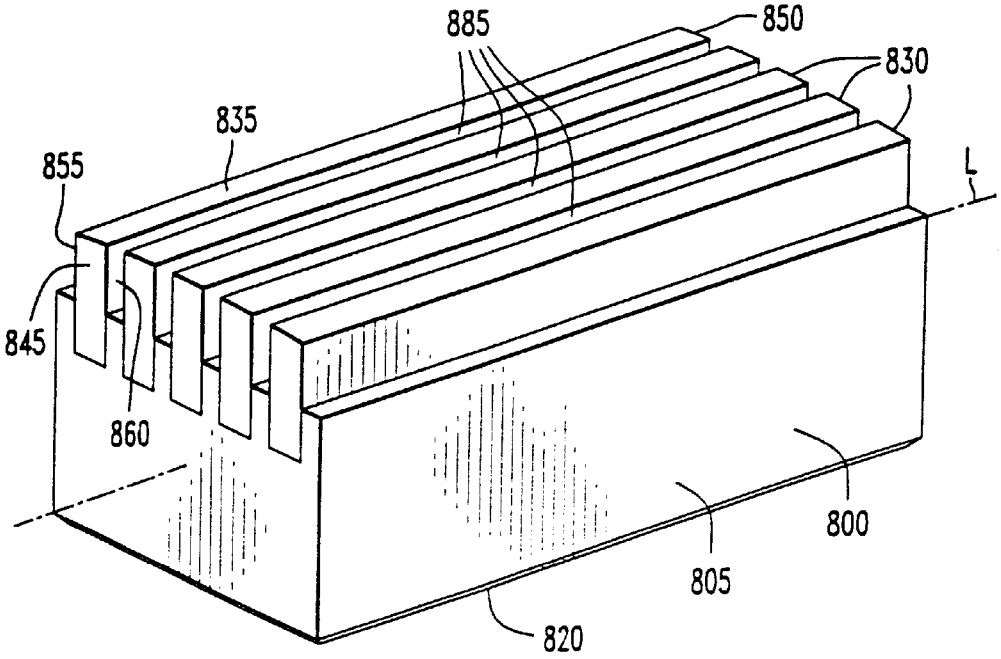
FIG. 12 is a perspective view of the abrasive pad viewed toward the top face.
Figure 13:
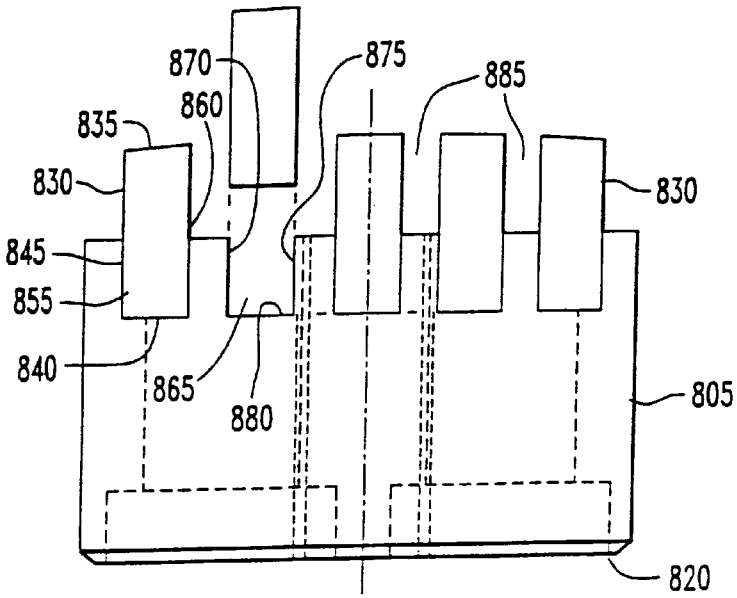
FIG. 13 is an end view of the abrasive pad in FIG. 12.

Details of the abrasive elements 830 on the abrasive pad 800 are illustrated in FIGS. 11–13. A series of polygonally shaped abrasive elements 830 are mounted to the base 805 of the abrasive pad 800. The abrasive elements 830 each may be generally rectangular in shape and have a top 835, bottom 840, ends 845, 850 and side walls 855, 860. The base 805 is generally rectangular in shape and has a series of recesses 865 therein with recess walls 870, 875 and a floor 880 which are conformed to the side walls 855, 860 of each element 850 thereby securing each element 830 within a respective recess 865 in an orientation such that each element 830 is parallel along the longitudinal axis L to the adjacent element 830. For illustrative purposes, one abrasive element has been removed from FIG. 13 to expose a recess 865.

The recesses 865 may be larger than the elements 830, and under these circumstances the elements 830 may be secured using a bonding agent such as adhesive well-known to those skilled in the art. Furthermore, the abrasive pad 800 may have a single unitary abrasive body rather than a plurality of individual elements, wherein the abrasive element is mounted thereto and has a plurality of grooves formed therein to provide an arrangement similar to that illustrated in FIGS. 9–11 but with a single grooved abrasive element.

Each abrasive element 830 may be made up of abrasive granules such as silica carbide having a grit size of approximately 25 microns, although this size may be selected based upon the work surface material and desired finish. In the alternative, the abrasive element 830 may be made up of a layer of abrasive material mounted or supported upon a substrate of another material. The abrasive element 830 should have an outer surface of abrasive material.

The abrasive elements 830 are laterally spaced from one another to define grooves 885 therebetween. These grooves 885 not only promote ejection of residue and swarf during the machining operation, they also act as passageways for air to cool each element 835.

A typical abrasive pad 800 may have a generally rectangular shape with a width of about 0.75 inch and a length of about 1.50 inches. The width of an individual element 830 may be about 0.10 inch with a groove 885 having a width of approximately 0.05 inch between each element 830.

One application for the apparatus described in the invention is for abrading the circular shape interior diameter of brake drums. The abrasive pad 800 is oriented against the workpiece such that the grooves 885 are positioned generally parallel to the longitudinal axis of the workpiece. Although the abrasive pad 800 may float on the pad holder 600 to contact the workpiece 900 (FIG. 1), the individual abrasive elements 830 may also be shaped to conform to the contour of the workpiece 900. As illustrated in FIG. 13, each abrasive element 830 has a top surface 835 which is curved along an arc having a diameter. The arc is common to the top surface of each other element to define a curved profile which conforms to the curved workpiece 900.

As previously mentioned, the extension rate 965 (FIG. 3*c*) and the retraction rate 970 may be different and it is likely the retraction rate 970 which is spring controlled may be greater than the extension rate 965, which is controlled by the pressurized fluid. The retraction rate 970 and furthermore the overall displacement of the piston assembly may be selected by selecting a coil spring 520 with a desired spring rate. A higher spring rate would create a faster retraction rate 970 but a lower displacement and a slower extension rate 965. On the other hand, a lower spring rate would accomplish the opposite result.

Additionally, the rate of introduction of pressurized fluid into the piston cylinder 605 will influence the rate of extension 965. A high pressure fluid quickly introduced in the piston cylinder 605 will generate a high rate of extension.

The pressurized fluid utilized to reciprocate the reciprocating unit may be supplied by pressurized fluid generally available on machine tools. However, this pressure is constant and in order to operate the subject invention it is necessary to have the pressurized fluid cycled between a high pressure of approximately 1200 psi necessary to displace the piston assembly to the extended position and a low pressure of approximately 500 psi under which the spring 520 will return the holder 600 to the retracted position. To accomplish this, it is necessary to utilize a metering device capable of turning the fluid on and off at a rapid rate to provide the desired reciprocation of the piston assembly and also provide an avenue for the pressure to quickly drop when the pressure supply is stopped. A typical cycling rate of pressurized fluid may be ten pulses of fluid every second.

One such metering device may be made of a pressure regulator connected to a solenoid valve, which is controlled by a timer. The cycling rate of pressurized fluid may be adjusted by the timer. Such a metering device ma be constructed by one of ordinary skill in the art using commercially available components.

The same fluid pressure that is used to move the holder 600 to the extended position is also utilized to cool the abrasive pad 800 and to prevent residue from entering the space between the abrasive pad 800 and the holder 600. Pressurized fluid in the piston cylinder 605 is directed to an internal passageway 710 (FIG. 8) within the body 625 of the holder 600 which is then directed to the outlet port 715 on the mounting surface 675 to the cavity 677 within which the housing 600 is positioned.

In this manner the pressurized fluid not only acts to move the holder 600 to the extended position, as previously discussed, but also may build up within the cavity 677 and act against the pad 800 to urge the pad base 805 from the cavity 677 thereby providing a downward vertical force upon the pad base 805 which would be translated to a force of the abrasive pad 800 against the workpiece 900. As a general guideline, the width of the abrasive pad 800 is about 0.005 inch less than the width of the cavity 677 and the length of the abrasive pad 800 is about 0.02 inch less than the width of the cavity 677. This provides a small enough gap between the pad body 805 and cavity 677 for the pad

800 to move within the cavity and at the same time for the pressurized fluid to act against the pad 800 to urge it from the cavity 677. Furthermore, the pressurized fluid within the cavity 677 acting against the abrasive pad 800 acts to cool the abrasive pad 800 and ensures no residue will enter the space of the cavity 677 between the abrasive pad 800 and the holder 600 thereby promoting smooth operation of the subject apparatus. Additionally, pressurized fluid escapes from the cavity 677 by traveling through the gap along the perimeter of the abrasive pad body 805. This fluid upon escaping flows against the workpiece thereby clearing debris and swarf from the workpiece surface. Finally, there is sufficient clearance between the dowel pins 670*a–d* (FIG. 10) and the bores 815*a–d* in the abrasive pad body 805 that pressurized fluid in the cavity 677 also escapes through these bores 815*a–d*. In the event the abrasive elements 830 are made of a porous material, then the pressurized fluid permeates the elements 830 for additional cooling and removal of residue and swarf from the workpiece.

The apparatus so far described has been directed to an abrasive pad used to abrade the surface of a rotating brake drum. This embodiment has been described for convenience only and it should be appreciated this arrangement may be used to finish other surfaces such as flat surfaces. However, for this application it may be desirable to form the top surface of each abrasive element to define a common plane.

Furthermore, the relative motion between the abrasive pad and the workpiece may be produced by other than a rotating workpiece. In particular, the workpiece could be moved linearly or in the alternative the workpiece could remain stationary while the apparatus not only reciprocates but also moves in a direction across the workpiece transverse to the direction of reciprocation.

The apparatus described herein may be used in the following fashion, as illustrated in FIG. 1. With a brake drum, for example, mounted upon a chuck on a lathe, the adapter 10 is attached to the slide 11 (FIG. 2) of the lathe. The abrasive pad 800 is positioned against the workpiece 900 to a predetermined force which will define the pad 800 pressure against the workpiece 900. The brake drum is then rotated to produce relative motion between the pad 800 and workpiece 900. Pressurized fluid is then introduced into the reciprocating unit 400 in controlled pulses thereby causing the pad 800, which is attached to the reciprocating unit 600, to reciprocate. The reciprocating unit 600 positions the pad 800 in an extended position at a slower rate than the pad 800 is returned to the retracted position. This uneven rate of reciprocating produces an uneven surface pattern and the desired finish. However, this reciprocation may be supplemented by secondary reciprocation provided to the adapter 10 by the machine tool. In this case the pad 800 would experience compound reciprocation caused by the reciprocating unit in one instance and the machine tool in the other instance. The uneven motion of the reciprocating unit may be unnecessary when the machine tool is independently reciprocating the abrasive element.

The present invention may, of course, be carried out in other specific ways other than those herein set forth without departing from the spirit and the essential characteristics of the invention. The present embodiments are, therefore, to be considered in all respects as illustrative and not restrictive, and all changes coming within the meaning and equivalency range of the appended claims are intended to be embraced therein.

What is claimed is:

1. A holder for an abrasive pad reciprocated with a reciprocating assembly to finish the surface of a moving workpiece comprising:

(a) a housing which is attached to the reciprocating assembly, wherein the housing has a mounting surface;

(b) an abrasive pad having a mounting surface which is oriented opposite the housing mounting surface;

(c) at least one primary spring positioned between the mounting surface of the housing and the mounting surface of the abrasive pad urging the housing and abrasive pad apart; and (d) a connector secured to one of the housing or abrasive pad and captured by other such that the housing and abrasive pad are resiliently attached to one another to allow multiple degrees of motion between the pad and housing.

2. The holder according to claim 1 wherein the mounting surface of the pad is generally parallel to the mounting surface of the housing.

3. The holder according to claim 1 including a plurality of primary springs positioned between and symmetrically about the housing and abrasive pad mounting surfaces.

4. The holder according to claim 1 wherein each primary spring is a coil spring.

5. The holder according to claim 1 wherein the holder has a bore extending therethrough with a reduced diameter section, wherein the connector is a bolt having a threaded shank and a head, wherein the bolt freely extends through the bore and the bolt head is captured by the reduced diameter section and wherein the bolt shank is threadably engaged with a mating threaded bore in the pad mounting surface to provide six degrees of freedom to the pad but limit the maximum distance between the opposing mounting surfaces of the pad and housing.

6. The holder according to claim 1 wherein the housing mounting surface is recessed within a cavity in the housing.

7. The holder according to claim 4 wherein each spring is recessed within a counterbore in a holder mounting surface for alignment.

8. The holder according to claim 4 wherein each spring is recessed within a counterbore in a pad mounting surface for alignment.

9. The holder according to claim 4 further including a dowel pin extending through each coil spring and into a bore within either the holder mounting surface or the pad mounting surface for alignment.

10. The holder according to claim 6 wherein a secondary spring is placed in compression over the bolt shank between the bolt head and the reduced diameter section of the housing bore thereby urging the abrasive pad toward the housing.

11. The holder according to claim 6 wherein the cavity has a shape conforming to a perimeter of the abrasive pad.

12. The holder according to claim 11 wherein the housing further includes a fluid passageway through the housing to the cavity for the introduction of pressurized fluid within the cavity.

13. The holder according to claim 12 wherein the cavity shape conforms to a perimeter of the abrasive pad to a degree such that pressurized fluid within the cavity urges the pad from the cavity.

14. The holder according to claim 13 wherein there exists a gap between the cavity and a perimeter of the abrasive pad to permit leakage of pressurized fluid past the pad.

* * * * *